US005950689A

United States Patent [19]

Varlet

[11] Patent Number: 5,950,689

[45] Date of Patent: Sep. 14, 1999

[54] BABY FEEDING BOTTLE HAVING A RECEPTACLE FOR A FLUIDIZED MASS AND METHOD OF USING SAME

[75] Inventor: Marc F. Varlet, Etel, France

[73] Assignee: SIEP SA, Etel, France

[21] Appl. No.: 09/065,903

[22] Filed: Apr. 24, 1998

[30] Foreign Application Priority Data

Jul. 30, 1997 [FR] France ..... 97 09989

[51] Int. Cl.[6] ..... B65B 1/04

[52] U.S. Cl. ..... 141/22; 141/381; 141/2; 215/11.1; 215/11.4; 215/DIG. 8

[58] Field of Search ..... 141/22–24, 380, 141/381, 18, 2; 215/11.1–11.6, DIG. 8

[56] References Cited

U.S. PATENT DOCUMENTS

| | | |
|---|---|---|
| 2,807,384 | 9/1957 | Lipari . |
| 5,071,017 | 12/1991 | Stull . |
| 5,217,433 | 6/1993 | Bunin . |
| 5,275,298 | 1/1994 | Holley, Jr. et al. . |
| 5,419,445 | 5/1995 | Kaesemeyer . |
| 5,542,922 | 8/1996 | Petterson et al. . |
| 5,570,796 | 11/1996 | Brown et al. . |

FOREIGN PATENT DOCUMENTS

| | | |
|---|---|---|
| 0 289 691 B1 | 7/1987 | European Pat. Off. . |
| 2 603 187 | 3/1988 | France . |
| 2 687 067 | 2/1992 | France . |
| 2 687 067 A1 | 2/1992 | France . |
| 2 715 062 | 1/1994 | France . |
| 2 715 062 A1 | 1/1994 | France . |
| WO96/30292 | 10/1996 | Germany . |
| WO97/25016 | 7/1997 | Germany . |

*Primary Examiner*—Steven O. Douglas
*Attorney, Agent, or Firm*—Lowe Hauptman Gopstein Gilman & Berner

[57] ABSTRACT

A baby feeding bottle has a body with a threaded neck onto which a tightening nut is screwed to keep a nipple in place. A removable receptacle carrying a fluidized mass to be mixed with liquid in the bottle body has a flange and open end, as well as a size and shape enabling it to be received in the bottle neck. While the receptacle is in the bottle, its flange rests on the bottle neck. The bottle carries a funnel-shaped cap that fits over the bottle neck to protect the bottle nipple or can be inverted to function as a funnel for facilitating pouring the fluidized mass into the baby bottle.

20 Claims, 5 Drawing Sheets

BABY FEEDING BOTTLE HAVING A RECEPTACLE FOR A FLUIDIZED MASS AND METHOD OF USING SAME

FIELD OF INVENTION

The present invention relates generally to baby feeding bottles and, more particularly, to a baby feeding bottle having a receptacle for a fluidized mass.

BACKGROUND ART

A prior art baby feeding bottle described, for instance, in French patent document A 2,603,187, includes a cylindrical neck having a threaded external circumference. A tightening nut keeps a nipple having an annular base in place against an upper edge of a neck of the bottle. A protective cup-shaped cap covers the nipple and nests in the nut perimeter. The French patent document also includes a substantially funnel-shaped cap which facilitates adding a liquid or solid ingredient to the bottle.

Receptacles in combination with baby feeding bottles are disclosed in Kaesemeyer U.S. Pat. No. 5,419,445 and Brown et al U.S. Pat. No. 5,570,796. In the '445 patent, a powdered milk storing receptacle is housed inside the bottle. The powdered milk flows from the receptacle into the bottle by dislodging a seal between the powdered milk and the remainder of the bottle from the receptacle bottom. The bottle disclosed in the '796 patent includes a receptacle adjacent the bottle for holding a liquid to maintain the liquid in the bottle at atmospheric pressure to prevent an infant from swallowing air.

The main drawback of the known designs is the structural complexity thereof which results in costly manufacture and cleaning difficulties. In addition, rough regions on components contacting the ingredients in the bottle are likely to cause unsanitary deposits containing bacteria. Since infants are highly susceptible to bacteria, the prior art bottles of the '445 and '796 patents have serious problems.

An object of the present invention is to provide a new and improved compartmentalization device for baby feeding bottles which has a simple design, is easy to use and to clean, is economical to manufacture, and has a tendency to be substantially bacteria free, and to a method of using same.

Another object of the invention is to provide a new and improved baby feeding bottle that is easy to handle, and to a method of using same.

The baby feeding bottle of the invention is designed to operate with a cap of the type disclosed generally in French Patent document A 2603187.

THE INVENTION

Accordingly, one aspect of a baby feeding bottle according to the invention includes a removable liquid impervious receptacle having a flange at its open end. The receptacle has a size and shape enabling it to be received in a neck of the bottle while resting on the flange on the neck of the bottle.

In one embodiment, the entire receptacle is rigid. In a variation, the receptacle has a flexible body and a rigid flange.

In another feature of the invention, the receptacle has a size and shape so it can be mounted inside a baby feeding bottle fitted with a funnel-shaped cap.

Another feature of the invention is that the receptacle is substantially cylindrical.

In yet another feature of the invention, the receptacle depth is less than the height of the bottle body and the receptacle has a cross-sectional diameter equal to or less than that of the bottle neck.

Another aspect of the invention relates to a baby feeding bottle including a nipple removably secured to an open top, in combination with a receptacle for carrying a fluidized mass. The receptacle mass is removably secured to the open top so it can be selectively inserted into and removed from the body. A cover selectively (1) surrounds the top of the body and the nipple while the nipple is in situ on the open top when the cover is in a first position and (2) is inserted into the top of the bottle to function as a funnel for facilitating pouring the fluidized mass into the body when the receptacle is removed from the body and the cover is in a second position inverted with respect to the first position.

A further aspect of the invention relates to a method of using a baby feeding bottle including a nipple removably secured to an open top, in combination with a receptacle that carries a fluidized mass. The receptacle mass is removably secured to the open top so it can be selectively inserted into and removed from the body. The top of the body and the nipple are surrounded with a cap while the nipple is in situ on the open top. An operator, i.e., the person feeding the baby, removes the cap and then the receptacle from the body. Then the operator inserts the cap into the open top of the bottle so the cap functions as a funnel. The operator then pours the fluidized mass from the receptacle through the cover into the body.

Preferably, the cover is configured so it fits over a neck of the bottle while it surrounds the top of the body and the nipple while the nipple is in situ on the open top and is tapered from the bottleneck toward the nipple top. The cover is inverted from this first position to a second position when it is inserted into the top of the bottle to function as a funnel.

The above and still further objects, features and advantages of the present invention will become apparent upon consideration of the following detailed description of several specific embodiments thereof, especially when taken in conjunction with the accompanying drawings.

BRIEF DESCRIPTION OF DRAWINGS

FIG. 1(*a*) is a sectional assembly view of a baby feeding bottle of a second kind fitted with a receptacle in accordance with a preferred second embodiment of the invention;

FIG. 4(*a*) is a sectional assembly view of a baby feeding bottle of the second kind fitted with a receptacle in accordance with a second preferred embodiment of the invention when said receptacle is used to pour an ingredient into the bottle.

DESCRIPTION OF THE PREFERRED EMBODIMENT

Figure 1:
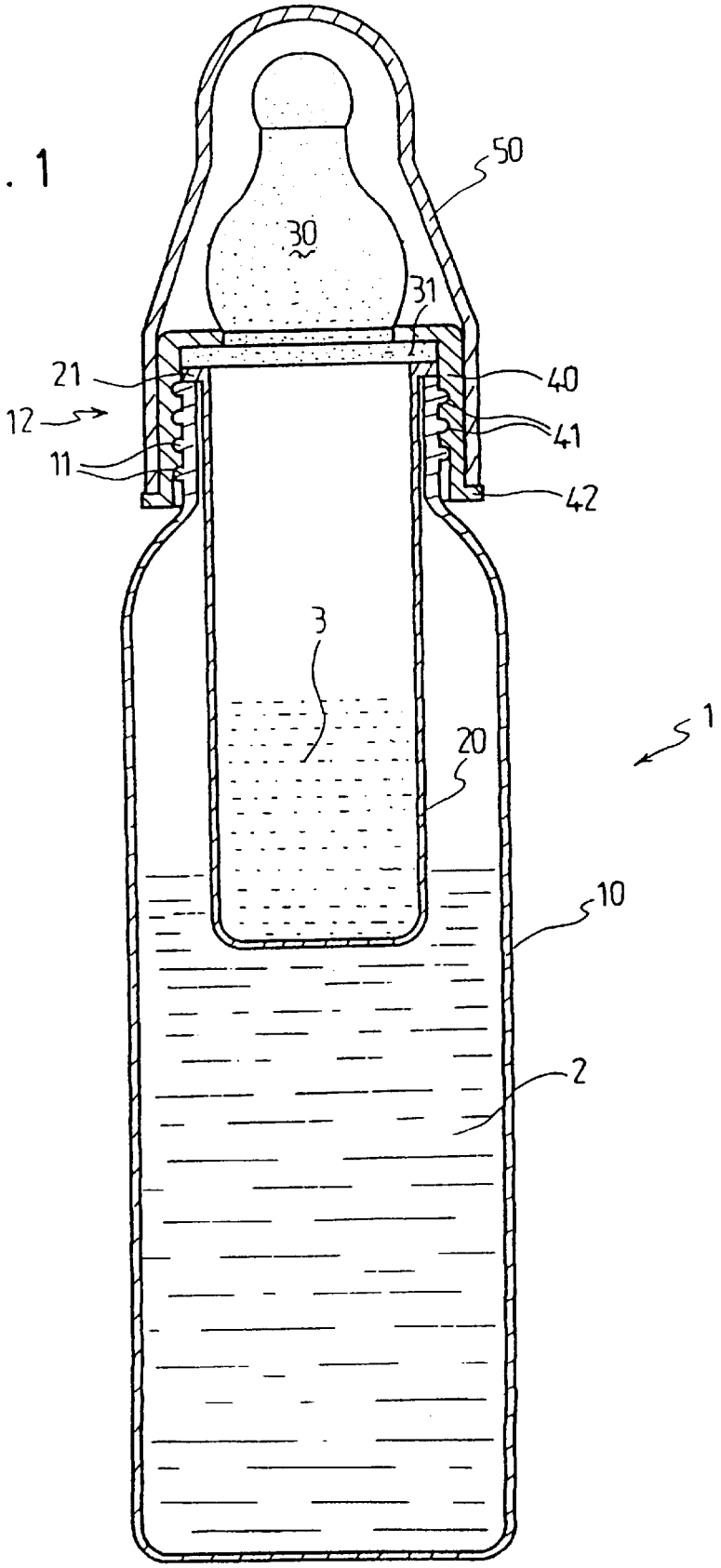
FIG. 1 is a sectional assembly view of a baby feeding bottle of a first kind fitted with a receptacle according to a first preferred embodiment of the invention.
Figure 1A:
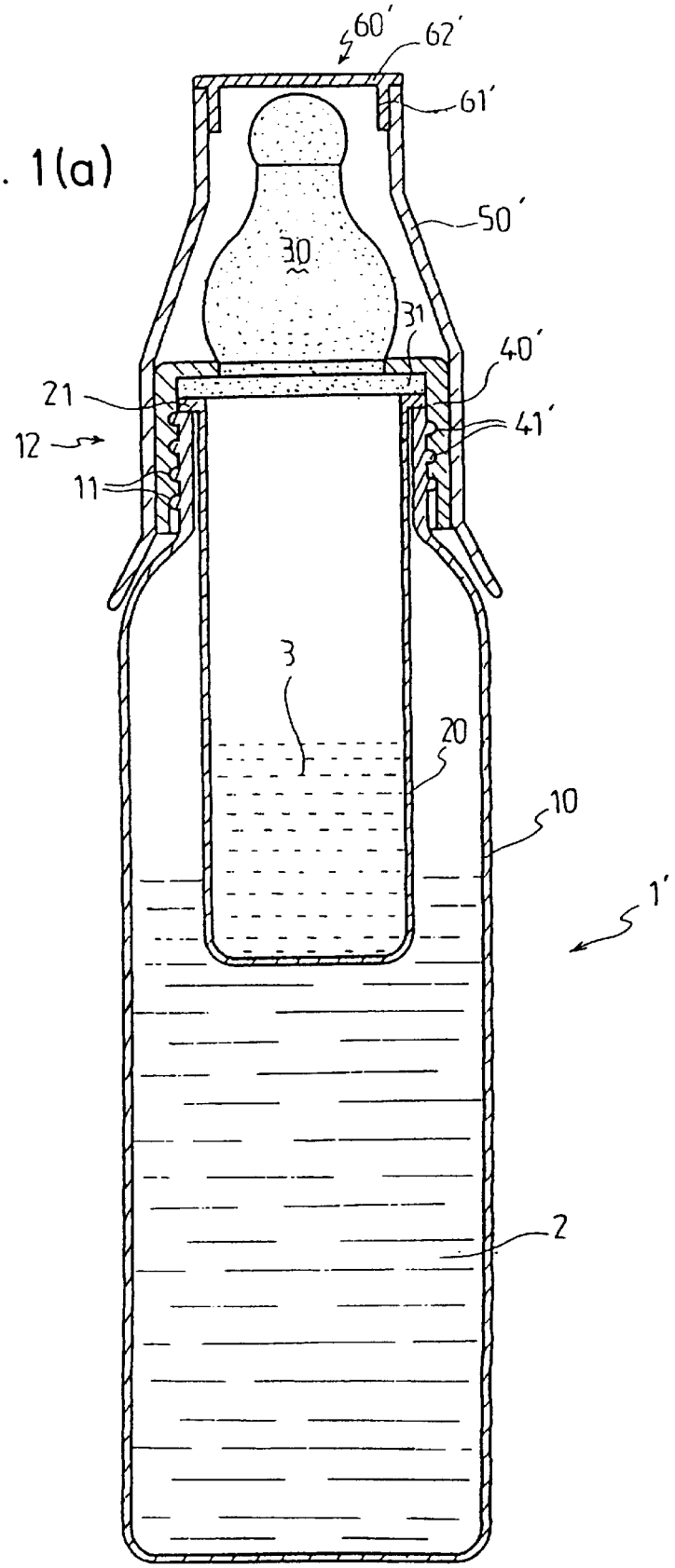

The baby feeding bottle 1 of FIG. 1 includes five components, namely main body 10, water impervious receptacle 20, nipple 30, tightening nut 40, and cap 50. Main body 10 of baby bottle 1 has a substantially cylindrical side wall and an open upper end. The upper end of body 10 includes neck 12 which is threaded on its outside. Receptacle 20 is housed entirely inside neck 12 of body 10.

Figure 2:
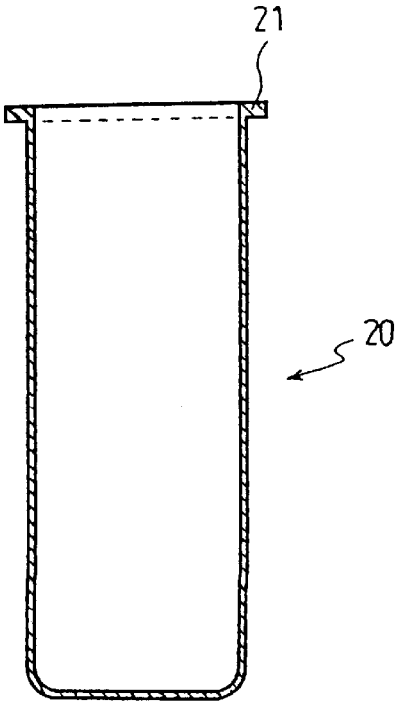
FIG. 2 is a detailed sectional view of a receptacle in accordance with a preferred embodiment of the invention.

Cylindrical receptacle 20 (shown in detail in FIG. 2) for carrying a fluidized mass 3, has an open upper open end from which extends flange 21 that rests on the upper edge of neck 12 of body 10 for carrying liquid 2 (preferably water). Fluidized mass 3 in receptacle 20 can be any of suitable solid or liquid, e.g., powdered milk, cereal, concentrated fruit juice or any other product to be diluted in a liquid, whether in powder or liquid form. Liquid 2 in body 10 of bottle 1 or 1' preferably is hot or cold water, or any other liquid suitable for baby foods.

The diameter of receptacle 20 is the same as or slightly less than the inner diameter of neck 12, whereas the diameter of flange 21 substantially equals the outer diameter of neck 12. To enable receptacle 20 to rest on neck 12, the diameter of flange 21 must be between the inner and outer diameters of neck 12.

All of receptacle 20 may be rigid, e.g., be glass or a rigid plastic such as polypropylene, or may have a flexible body and a rigid flange 21.

Figure 3:
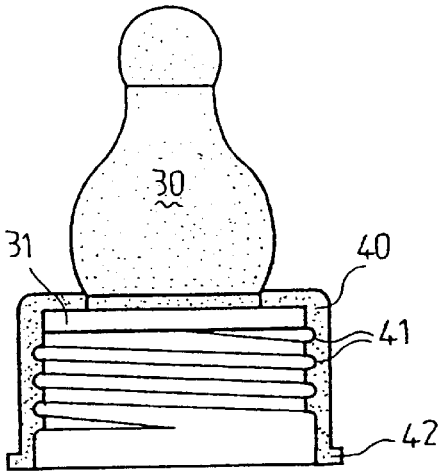
FIG. 3 is a detailed sectional view of a nipple-fitted tightening nut for use with the receptacle of FIG. 2 and the bottle of FIG. 1 or FIG. 1(*a*)

At the upper part of baby bottle 1, tightening nut 40 bears against annular base 31 of nipple 30 to cause base 31 to bear against flange 21 and neck 12 so nipple 30 is held in situ in the upper part of baby feeding bottle 1. Tightening nut 40 includes, for that purpose, threads 41 cooperating with threads 11 of neck 12 at the top of bottle 10. Tightening nut 40 also includes flange 42. Tightening nut 40 and nipple 30 are shown in detail in FIG. 3, Cap 50 nests, i.e., frictionally fits, on tightening nut 40. The lower end of cap 50 bears against and comes to a stop against flange 42 to cover the upper part, including nipple 30, of baby bottle 1. Cap 50 is a hollow element of revolution having a cylindrical shape at its lower part, a frustoconical shape in its middle part and a substantially hemispherical closed top part.

FIG. 1(*a*) is a cross sectional view of another kind of baby feeding bottle which differs from the bottle of FIG. 1 because of the configuration of its cap 50' and tightening nut 40'. The shape of the cap 50' is similar to that of the cap 50, except that cap 50' is open at both ends. Cap 50' has a lower flared opening to cover the base of neck 12 of body 10. The upper open end of cap 50', sealed by a generally flat stopper 50', is smaller than the lower opening so the lower end of cap 50' can encircle neck 12.

Stopper 60' includes downwardly depending tubular, cylindrical segment 51', that is concentric with circular plate-like base 61'. Cylindrical segment 61' nests inside the upper opening of the cap 50', with the exterior cylindrical wall of segment 61' bearing against the interior cylindrical wall of cap 50'.

Tightening nut 40' differs from tightening nut 40 since nut 40' does not include flange 41. Consequently, the lower part of cap 50' can extend below and encircle the lowest part of tightening nut 40'.

Figure 4:
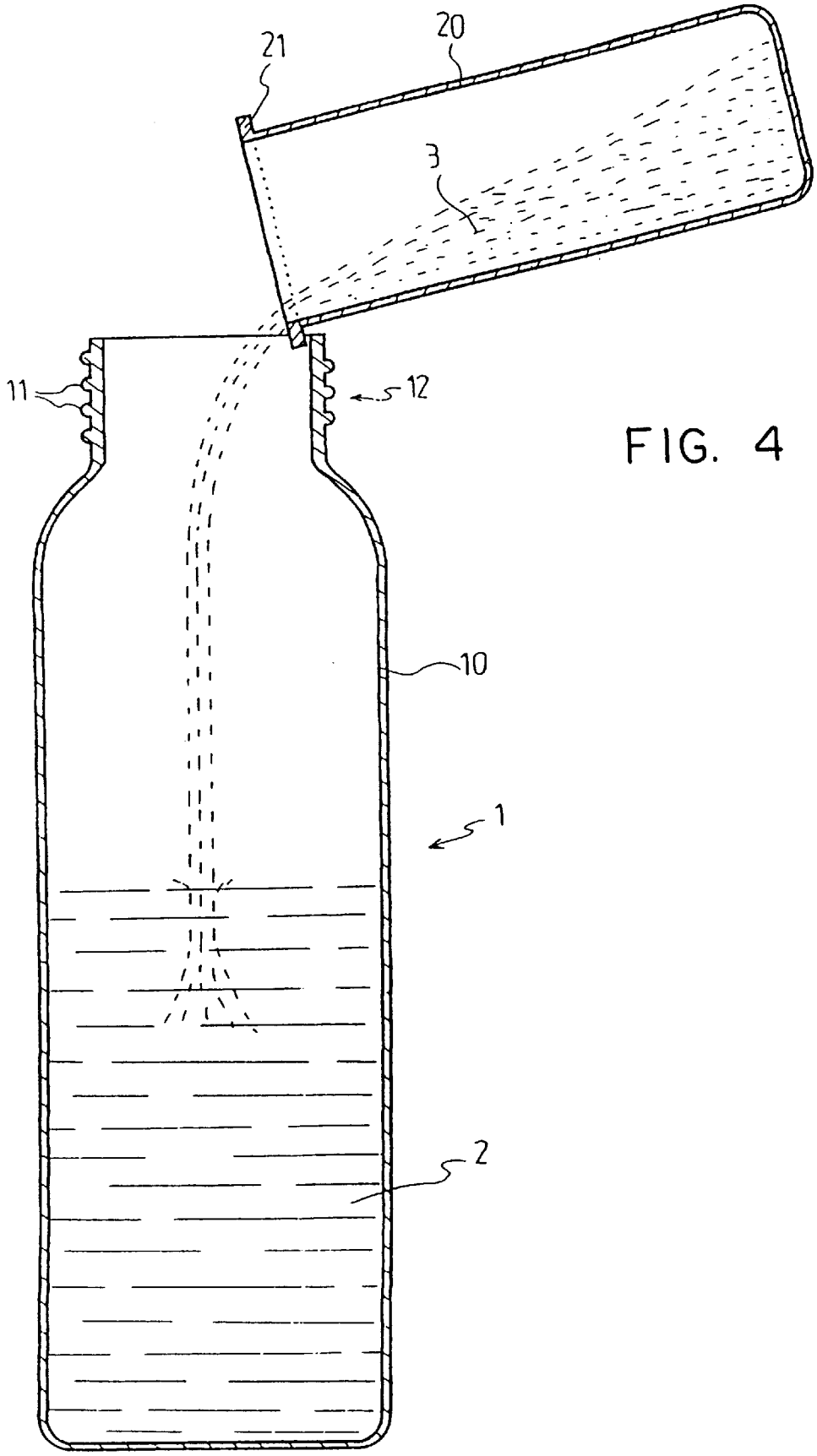
FIG. 4 is a sectional assembly view of a baby feeding bottle of the first kind fitted with a receptacle in accordance with the first preferred embodiment of the invention when said receptacle is used to pour an ingredient into said bottle.
Figure 4A:
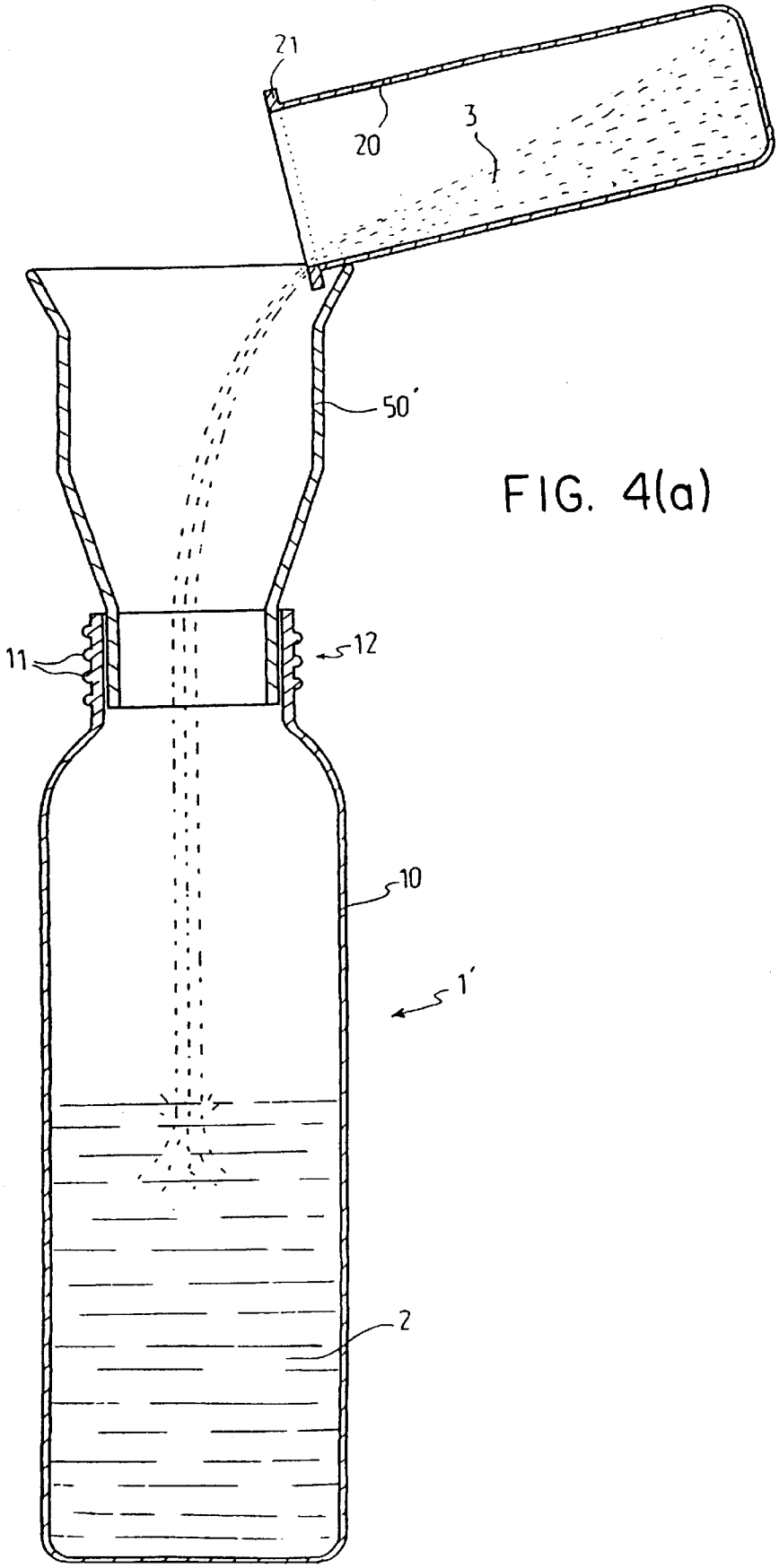

FIG. 4 is a drawing of bottle 1 when a beverage is being prepared and cap 50 is removed from the remainder of bottle 1. Tightening nut 40 is unscrewed, nipple 30 and receptacle 20 are removed from body 10. Receptacle 20 is positioned so fluidized mass 3 therein can be poured through neck 12 into body 10. Powdered product 3 then mixes with liquid 2 carried in body 10. To get the bottle ready so the resulting mixture can be drunk, nipple 30 is secured by tightening nut 40 to neck 12 of body 10.

FIG. 4(*a*) is an illustration of fluidized mass 3 being poured from receptacle 20 through cap 50' and thence neck 12 into liquid 2 in bottle 1'. The pouring and mixing procedure for bottle 1' in FIG. 4(*a*) is somewhat the same as for bottle 1 in FIG. 4.

An operator uses the structure of FIGS. 1(*a*) and 4(*a*) by first removing cover 50' from body 10. Then she removes nipple 30 and receptacle 20 by unscrewing nut 40'. Then she separates receptacle 20, including fluidized mass 3, from nipple 30, annular base 31 thereof and nut 40'. Then the operator removes stopper 60' from cap 50' and inverts cap 50' so the small opening of the cap is inside neck 12 of bottle 1', with the remainder of the cap 50' extending upwardly from neck 12. The operator then pours the fluidized mass 3 in receptacle 20 through cap 50' which functions as a funnel for facilitating pouring of fluidized mass 3. Then the operator pours fluidized mass 3 from receptacle 20 through cap 50' into body 10. The operator then removes cap 50' from neck 12 before mounting nipple 30 on the neck.

Because of the size and shape of receptacle 20, particularly its substantially cylindrical shape, receptacle 20 allows powder 3 to be conveniently poured from it into body 10. Flange 21 of receptacle 20 is thick enough, for instance 2 mm, to allow easy withdrawal of receptacle 20 from neck 12.

The entire fluidized mass 3 of receptacle 20 need not be poured into body 10. Receptacle 20 and the part of mass 3 remaining therein can be put back into body 10 of bottle 1 or 1', as illustrated in FIGS. 1 and 1(*a*). Receptacle 20 can have any suitable size and shape and/or holding volume provided the receptacle can fit inside body 10.

When tightening nut 40 or 40' is threaded onto neck 12, the thicknesses of the flange 21 and annular base 31 of the nipple 30 are between the top of neck 12 and tightening nut 40 or 40'. Therefore, the thickness of flange 21 and height of tightening nut 40 or 40' must be such as to allow the above-mentioned screw function. In an advantageous embodiment, the height of the tightening nut 40 or 40' is 25 mm for a flange 21 having a 22 mm thickness.

The size and shape of liquid impervious receptacle 20 are such as to (1) hold fluidizable mass 3 and (2) be immersed inside the liquid 2 in the body 10 without wetting mass 3. Receptacle 20 is made of an easily cleaned material, free of any danger of contaminating liquid 2 or fluidized mass 3. Consequently, the bottom of receptacle 20 is rounded to facilitate cleaning and avert the accumulation therein of food deposits that might present a bacterial danger to the baby.

While there have been described and illustrated specific embodiments of the invention, it will be clear that variations in the details of the embodiments specifically illustrated and described may be made without departing from the true spirit and scope of the invention as defined in the appended claims.

I claim:

1. A baby feeding bottle comprising a body, a nipple and a tightening nut, the body having a threaded neck for receiving the tightening nut to keep the nipple in place on the body, a removable liquid impervious receptacle having an open-end flange having a size and shape so the receptacle can fit into the neck of said bottle, the receptacle flange resting on said neck of said bottle while the receptacle is in the body, a removable liquid impervious plate on the open-end flange, the plate having an upper portion and side wall surrounded by and held in place on the flange by the tightening nut when the tightening nut is threaded in a tight position on the threaded neck to prevent escape of the liquid from the receptacle.

2. The baby feeding bottle of claim 1 wherein all of said receptacle is rigid.

3. The baby feeding bottle of claim 1 wherein said receptacle has a flexible body and a said flange thereof is rigid.

4. The baby feeding bottle of claim 1 wherein the bottle includes a funnel-shaped cover, said receptacle having a size and shape enabling it to be mounted on the bottle having the funnel-shaped cover.

5. The baby feeding bottle of claim 1 wherein said receptacle is substantially cylindrical.

6. The baby feeding bottle of claim 1 wherein said receptacle has a height less than the height of the body of said bottle and a maximum cross-sectional diameter at least equal to the inside cross-sectional diameter of said neck of said bottle.

7. The baby feeding bottle of claim 1 wherein the body has an open top, the nipple being removably secured to the open top so it can be selectively inserted into and removed from the body, a cover selectively (1) surrounding the top of the body and the nipple while the nipple is in situ on the open top when the cover is in a first position and (2) inserted into the top of the bottle to function as a funnel for facilitating pouring the fluidized mass into the body when the receptacle is removed from the body and the cover is in a second position inverted with respect to the first position.

8. The baby feeding bottle of claim 7 wherein the cover includes a removable cap, the cap when in situ on the cover while the cover is in the first position covering the nipple to prevent fluid egress to the nipple from outside the cover, the cap being removed from the cover while the cover is in the second position to permit egress of the liquid into the body.

9. A baby feeding bottle comprising a liquid-receiving body having an open top, a nipple removably secured to the open top, a liquid impervious receptacle for carrying a fluidized mass removably secured to the open top so it can be selectively inserted into and removed from the body, a cover selectively (1) surrounding the top of the body and the nipple while the nipple is in situ on the open top when the cover is in a first position and (2) inserted into the top of the bottle to function as a funnel for facilitating pouring the fluidized mass into the body when the receptacle is removed from the body and the cover is in a second position inverted with respect to the first position.

10. The baby feeding bottle of claim 9 wherein all of said receptacle is rigid.

11. The baby feeding bottle of claim 9 wherein said receptacle has a flexible body and a said flange thereof is rigid.

12. The baby feeding bottle of claim 9 wherein said receptacle is substantially cylindrical.

13. The baby feeding bottle of claim 9 wherein said receptacle has a height less than the height of the body of said bottle and a maximum cross-sectional diameter at least equal to the inside cross-sectional diameter of said neck of said bottle.

14. The baby feeding bottle of claim 9 wherein the cover includes a removable cap, the cap when in situ on the cover while the cover is in the first position covering the nipple to prevent fluid egress to the nipple from outside the cover, the cap being removed from the cover while the cover is in the second position to permit egress of the liquid into the body.

15. The baby feeding bottle of claim 9 further including a removable liquid impervious plate on an open-end flange, the plate having an upper portion and side wall surrounded by and held in place on a flange by a tightening nut when the tightening nut is threaded in a tight position on a threaded neck of the body to prevent escape of the liquid from the receptacle.

16. A method of using a baby feeding bottle including a nipple removably secured to an open top of a body of the bottle, a receptacle for carrying a fluidized mass, the receptacle being removably secured to the open top so it can be selectively inserted into and removed from the body, the top of the body and the nipple being surrounded with a cover while the nipple is in situ on the open top, the method comprising removing the cover, then removing the receptacle from the body, then inserting the cover into the top of the body to enable the cover to function as a funnel, then pouring the fluidized mass from the receptacle through the cover into the body.

17. The method of claim 16 wherein the cover is configured so it fits over a neck of the bottle while the cover is in a first position surrounding the top of the body and the nipple, the cover being tapered from the bottle neck toward the nipple top while the nipple is in situ on the open top, the method further comprising inverting the cover from said first position to a second position when it is inserted into the top of the bottle to function as a funnel.

18. The method of claim 17 wherein the cover includes a removable cap, the cap being in situ in the cover while the cover is in the first position, and removing the cap from the cover prior to the cover being in the second position so that the cap is removed from the cover when the cover is in the second position.

19. The method of claim 18 further including positioning a liquid impervious plate between the open top and the nipple to hold the fluidized mass in place in the receptacle while the nipple is in situ on the open top, and removing the plate from the body prior to dispensing liquid from the body through the nipple and prior to inserting the cover into the top of the body so the plate does not block the dispensing of (a) liquid from the body through the nipple and (b) the fluidized mass from the receptacle into the body when the cover is inserted into the top of the body.

20. The method of claim 16 further including positioning a liquid impervious plate between the open top and the nipple to hold the fluidized mass in place in the receptacle while the nipple is in situ on the open top, and removing the plate from the body prior to dispensing liquid from the body through the nipple and prior to inserting the cover into the top of the body so the plate does not block the dispensing of (a) liquid from the body through the nipple and (b) the fluidized mass from the receptacle into the body when the cover is inserted into the top of the body.

* * * * *